United States Patent [19]

Millet

[11] Patent Number: 4,804,945

[45] Date of Patent: Feb. 14, 1989

[54] DOOR ALARM WITH INFRARED AND CAPACITIVE SENSORS

[76] Inventor: Terrance Millet, 26 Hyman Dr., Dollard-des-Ormeaux, Quebec, Canada, H9B 1L4

[21] Appl. No.: 114,044

[22] Filed: Oct. 29, 1987

[51] Int. Cl.[4] ..... G08B 13/00; G08B 13/18; G08B 13/26

[52] U.S. Cl. ..... 340/541; 340/562; 340/567; 340/693

[58] Field of Search ..... 340/541, 562, 563, 567, 340/521, 693

[56] References Cited

U.S. PATENT DOCUMENTS 3,785,230 1/1974 Lokey ..... 83/58

4,325,058 4/1982 Wagner et al. ..... 340/562

*Primary Examiner*—Glen R. Swann, III

*Attorney, Agent, or Firm*—Jerry T. Kearns

[57] ABSTRACT

An alarm system for providing separate discrete signals corresponding with the approach of an individual to a door and the touching of the door knob by the individual utilizes a combination of infrared sensors and a capacitive discharge sensor. The infrared sensors are mounted on a circular ring on the face of the door knob. The sensors are angled in different directions to detect individuals approaching from various directions. The door knob is composed of a metallic material and acts as an antenna of a capacitive discharge proximity sensor. The door knob is insulated by a sleeve from the rest of the door and latch structure. Approach of an individual is detected by the infrared sensors which activates a first alarm signal. When the individual reaches for and touches the door knob, a second different alarm is activated.

7 Claims, 2 Drawing Sheets

DOOR ALARM WITH INFRARED AND CAPACITIVE SENSORS

BACKGROUND OF THE INVENTION

1. Field of the Invention

The present invention relates to door alarms, and more particularly pertains to a new and improved alarm system which combines infrared and capacitive discharge sensors to provide discrete signals upon the approach of an individual and the touching of the door knob by the individual. Various types of infrared, photoelectric and mechanical alarm devices have been developed for the detection of the tampering of a lock mechanism by an individual. These conventional types of alarm systems do not provide separate indications depending whether an individual has merely approached the door or is actually tampering with the lock mechanism. The alarm system of the present invention is also useful as a door bell. Conventional alarm systems are complicated, expensive and difficult to install. The present invention overcomes these problems by providing an alarm system formed integrally with a door knob. Thus, the alarm system of the present invention may be installed by merely replacing the door knob.

2. Description of the Prior Art

Various types of door alarms are known in the prior art. A typical example of such a door alarm is to be found in U.S. Pat. No. 1,604,978, which issued to T. Cronin on Nov. 2, 1926. This patent discloses an alarm which is mechanically actuated by contacts in a door latch mechanism. U.S. Pat. No. 1,639,565, which issued to G. Jakopec et al on Aug. 16, 1927, discloses a door alarm device which activates an alarm upon operation of the sliding bolt of a door lock mechanism. U.S. Pat. No. 1,695,077, which issued to A. Zukor et al on Dec. 11, 1928, discloses a combined door latch and alarm. When forced entry is attempted, the door latch mechanism actuates a mechanical rotary bell. U.S. Pat. No. 3,659,549, which issued to W. Wagner on May 2, 1972, discloses a lock alarm mechanism for vending machines which utilizes a key operated latch member on a hinged housing door which actuates an alarm upon attempted forced entry of the door. U.S. Pat. No. 3,785,230, which issued to R. Lokey on Jan. 15, 1974, the disclosure of which is hereby incorporated by reference, discloses an automatic safety brake for a rotary saw which utilizes a capacitive discharge sensor which actuates an alarm bell upon approach of an individual's hand within close proximity to the saw blade. U.S. Pat. No. 4,453,390, which issued to P. Moritz et al on June 12, 1984, discloses a lock monitoring alarm. A photo sensitive circuit is utilized to detect and monitor the position of the lock. A visual display is provided for allowing individuals to monitor the condition of the lock from a remote location.

While the above mentioned devices are suited for their intended usage, none of these devices provide a door alarm system which activates separate discrete signals indicating the approach of an individual to a door and the touching of the door knob by the individual. Further, none of the aforesaid devices provide a combination infrared and capacitive discharge proximity sensor integrally formed with a door knob. Inasmuch as the art is relatively crowded with respect to these various types of door alarms, it can be appreciated that there is a continuing need for and interest in improvements to such door alarms, and in this respect, the present invention addresses this need and interest.

SUMMARY OF THE INVENTION

In view of the foregoing disadvantages inherent in the known types of door alarms now present in the prior art, the present invention provides an improved door alarm. As such, the general purpose of the present invention, which will be described subsequently in greater detail, is to provide a new and improved door alarm which has all the advantages of the prior art door alarms and none of the disadvantages.

To attain this, a representative embodiment of the concepts of the present invention is illustrated in the drawings and makes use of a door knob provided with a circular ring mounting a plurality of infrared detectors angled in different directions. The circular ring is mounted around the keyhole on the front face of the door knob. The door knob is formed from a metallic material and is utilized as the antenna of a capacitive discharge proximity sensor. The infrared sensors activate an alarm upon approach of an individual and the capacitive discharge sensor provides a separate discrete alarm signal if the individual touches the door knob. An insulating sleeve surrounds the shaft of the door knob and insulates the door knob from the door and door latch mechanism.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door alarm which has all the advantages of the prior art door alarms and none of the disadvantages.

It is another object of the present invention to provide a new and improved door alarm which may be easily and efficiently manufactured and marketed.

It is a further object of the present invention to provide a new and improved door alarm which is of a durable and reliable construction.

An even further object of the present invention is to provide a new and improved door alarm which is susceptible of a low cost of manufacture with regard to both materials and labor, and which accordingly is then susceptible of low prices of sale to the consuming public, thereby making such door alarms economically available to the buying public.

Still yet another object of the present invention is to provide a new and improved door alarm which provides in the apparatuses and methods of the prior art some of the advantages thereof, while simultaneously overcoming some of the disadvantages normally associated therewith.

Still another object of the present invention is to provide a new and improved door alarm which provides separate discreet signals indicating the approach of an individual to the door and the touching of the door knob by the individual.

Yet another object of the present invention is to provide a new and improved door alarm which utilizes infrared and capacitive discharge sensors mounted in a door knob to indicate the approach of an individual to the door and the touching of the door knob by the individual.

Even still another object of the present invention is to provide a new and improved door alarm which may be easily installed by merely replacing the door knob.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
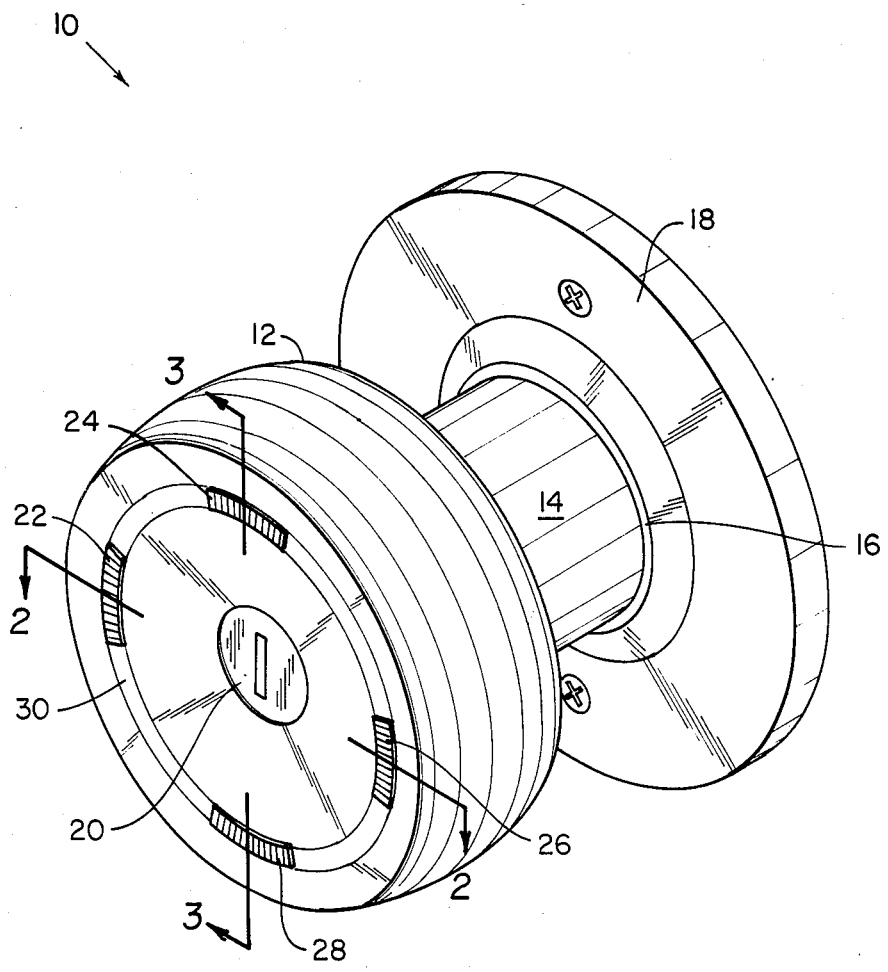
FIG. 1 is a perspective view of a door knob embodying the door alarm system of the present invention.

With reference now to the drawings, and in particular to FIG. 1 thereof, a new and improved door alarm embodying the principles and concepts of the present invention and generally designated by the reference numeral 10 will be described.

More specifically, it will be noted that the first embodiment 10 of the invention includes a metallic door knob 12 attached to a shaft 14. An insulating sleeve 16 disposed around the shaft 14 electrically insulates the door knob 12 and shaft 14 from the door latch mechanism and the door 18. Conventional key cylinder 20 is provided on the front face of the door knob 12 for actuation of a conventional latch mechanism. A plurality of infrared sensors 22, 24, 26 and 28 are circumferentially spaced around a mounting ring 30. The mounting ring 30 is recessed in the front face of the door knob 12 around the key cylinder 20. The first infrared sensor 22 is angled to the left, the infrared sensor 24 is directed straight ahead, the infrared sensor 26 is angled to the right and the infrared sensor 28 is angled downwardly. In this manner, individuals approaching the door 18 from any direction will be detected. The infrared sensors 22, 24, 26 and 28 are of the conventional type utilized in security alarm systems, and are commercially available from a variety of sources. The metallic door knob 12 is connected to a capacitive discharge proximity sensor. This capacitive discharge proximity sensor may be of the type utilized in U.S. Pat. No. 3,785,230, the disclosure of which is hereby incorporated by reference. When an individual places his hand in close proximity to or touches the door knob 12, a small stored capacitive charge will be discharged, activating an alarm signal. A timing circuit may be incorporated so that the capacitive discharge sensor will not activate the alarm for a specified time period after the door knob 12 is touched, to allow a person legitamately entering the door to deactivate the alarm by a switch within the interior of the building. Similarly, a radio frequency remote transmitter similar to a garage door opener may be utilized to broadcast a digitally coded radio frequency signal to deactivate a frequency controlled switch connected to the alarm units at a remote distance from the door. A grounded metal doormat may be provided to enhance the operation of the capacitive discharge sensor, although this has been found to be unnecessary in practice.

Figure 2:
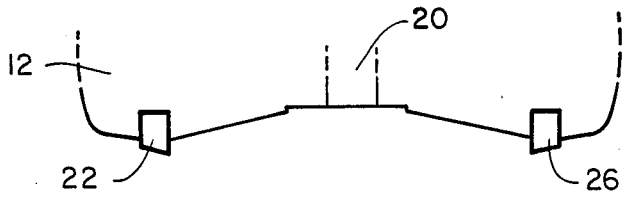
FIG. 2 is a cross sectional view taken along line 2—2 of FIG. 1, illustrating two differently angled infrared sensors.

With reference now to FIG. 2, a cross sectional view illustrating the angled direction of the infrared sensors 22 and 26 is provided. It may now be understood that the sensor 22 will detect individuals approaching from the left and the sensor 26 will detect individuals approaching from the right.

Figure 3:
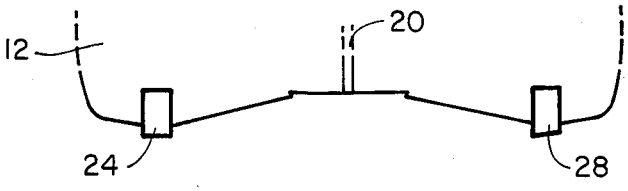
FIG. 3 is a cross sectional view taken along line 3—3 of FIG. 1, illustrating two more differently angled infrared sensors.

As shown in FIG. 3, infrared sensor 24, which is disposed at the top of the door knob 12, is directed straight ahead to detect individuals approaching from that direction. The bottom infrared sensor 28 is angled downwardly to detect individuals which may be attempting to crawl to the door. In this manner, it is insured that individuals approaching the door from any direction will be detected.

Figure 4:
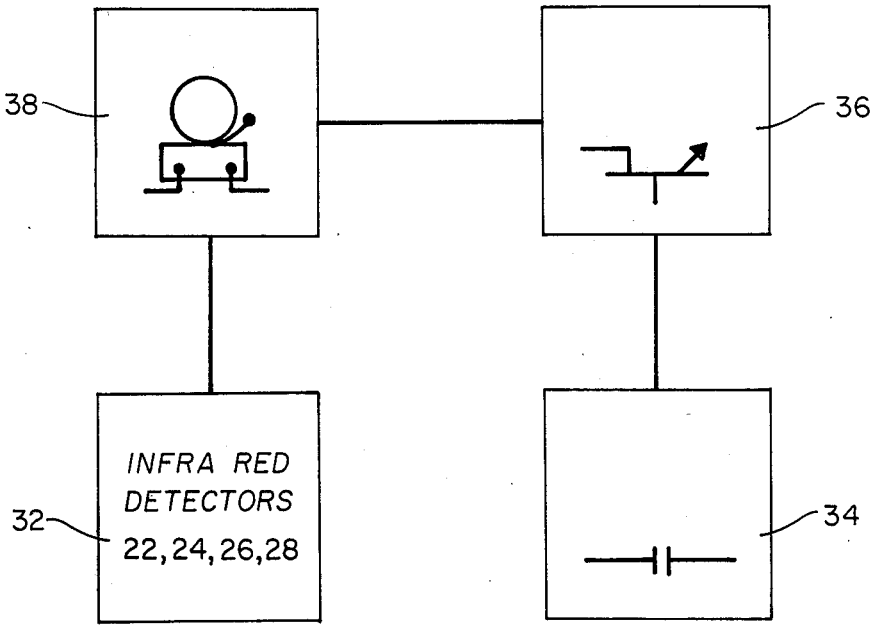
FIG. 4 is a diagrammatic view illustrating the components of the door alarm of the present invention.

With reference now to FIG. 4, the various components of the alarm system of the present invention will now be described. Infrared detectors 22, 24, 26 and 28 are connected to a conventional control system 32. This control system 32 is of the usual type utilized in home security systems. The control system 32 also includes manually activated switches for disabling the alarm units. The control system 32 is connected for actuation of a bell 38. This bell may be also connected for use as a door bell. The capacitive discharge sensor 34 is connected to a transistorized repeater 36. This repeater may also be constructed as a mechanical relay. The repeater 36 is preferably connected to the same bell 38, although it may connected to a separate bell which provides a different alarm tone than that given by bell 38. Thus, in use, when the approach of an individual is detected by any one of the infrared detectors 22, 24, 26 and 28, the bell 38 will be activated to give one ring. If the individual approaches in close proximity to the door knob 12, or touches the door knob 12, the bell 38 will be repeatedly actuated. This system provides two separate discrete signals for indicating both the approach of an individual to the door 18 and the touching of the door knob 12 by the individual. A variety of mechanical or electronic audible alarms may be utilized as the alarm bell 38. The capacitive discharge proximity sensor 34 may be provided with an adjustment to regulate the distance from the door knob 12 at which the individual will activate the alarm 38. The capacitive discharge proximity sensor 34 is of conventional construction and includes an amplifier, a discriminator and an electronic relay as disclosed in the previously mentioned U.S. Pat. No. 3,785,230. Power for the infrared sensors and the capacitive discharge sensor may be supplied by tapping an existing door bell transformer. The connections may be formed by wires extending through the door interior, or by a flat tape applied to the interior surface of the door. This tape may be color coordinated with the door to be unobtrusive. Alternatively, the sensors may be powered by an internal battery within the door knob. In this case, a conventional low battery alarm circuit of the type used in smoke detectors would be incorporated.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A door alarm for providing two separate discrete signals indicating approach of an individual to a door and touching of the door knob by the individual, comprising:

a metallic door knob on said door;

a shaft connected to said door knob and a latch mechanism on said door;

insulating means for electrically insulating said door knob and said shaft from said door and said latch mechanism;

a key lock cylinder extending through a front face of said door knob;

a circular mounting ring on said front face of said door knob surrounding said key lock cylinder;

four infrared sensors spaced circumferentially at ninety degree intervals around said mounting ring;

first control means connected to said infrared sensors;

audible alarm means activated by said control means in response to approach of an individual to said door to provide a first signal;

a capacitive discharge sensor connected to said metallic door knob;

second control means connected to said capacitive discharge sensor; and means connected to said second control means for providing a second signal in response to touching of said door knob by an individual.

2. A door alarm, comprising:

door knob means;

infrared sensor means on said door knob means for detecting approach of an individual remote from said door knob; and alarm means connected to said infrared sensor means activated by said approach of an individual.

3. A door alarm, comprising:

door knob means;

sensor means on said door knob means for detecting approach of an individual remote from said door knob;

said sensor means comprising at least one infrared sensor and a capacitive discharge sensor; and alarm means connected to said sensor means activated by said approach of an individual.

4. The door alarm of claim 3, further comprising a circular mounting ring on a front face of said door knob means; and a plurality of infrared sensors circumferentially spaced around said ring.

5. The door alarm of claim 4, wherein said plurality of infrared sensors are each angled in a different direction to detect individuals approaching from various directions.

6. The door alarm of claim 3, wherein said door knob means is formed from a metallic material and is an antenna of said capacitive discharge sensor.

7. The door alarm of claim 6, wherein said door knob means includes a shaft; and insulating means on said shaft for electrically insulating said door knob means and said shaft from a door.

* * * * *